United States Patent [19]

Bremer

[11] 4,315,327

[45] Feb. 9, 1982

[54] AIR OPERATED CLOCK

[76] Inventor: Edgar W. Bremer, P.O. Box 47, Okolona, Ohio 43550

[21] Appl. No.: 173,896

[22] Filed: Jul. 29, 1980

[51] Int. Cl.[3] ..... G04B 1/26

[52] U.S. Cl. ..... 368/65

[58] Field of Search ..... 368/54, 65; 92/33; 137/624.11, 624.22

[56] References Cited

U.S. PATENT DOCUMENTS

| | | | |
|---|---|---|---|
| 2,770,941 | 11/1956 | Flagiello | 368/65 |
| 3,117,413 | 1/1964 | Pulaski et al. | 368/6 |
| 3,831,371 | 8/1974 | Vatterott | 368/65 |
| 4,170,869 | 10/1979 | Bremer | 368/54 |

*Primary Examiner*—Vit W. Miska

*Attorney, Agent, or Firm*—Harvey B. Jacobson

[57] ABSTRACT

An apparatus for connection to a periodic, pulsed air supply for providing an indication of time based on receipt of the air pulses comprises a rotor having an externally visible pointer. The rotor is mounted in a cylindrical housing and includes a first section which moves axially of the housing under the force of an air pulse. Teeth are formed on the rotor first section which coact with stationary teeth mounted on the housing interior to force the rotor first section to rotate a predetermined amount. This rotation is transmitted to a second axially stationary rotor section by a keyed connection between the rotor sections. The axially movable section is forced to its original position by a spring mounted in the housing.

8 Claims, 5 Drawing Figures

AIR OPERATED CLOCK

BACKGROUND OF THE INVENTION

1. Field of the Invention

This invention relates to air pressure operated time keeping devices.

2. Discussion of Related Art

U.S. Pat. No. 4,170,869, which is the inventor's own prior patent, discloses an air operated hour clock having an axially displaceable rotor mounted in a cylindrical housing with a shaft extending axially from the housing which mounts an indicator hand. In operation, the rotor, shaft and indicator are displaced axially of the housing and rotate through engagement of coacting teeth spaced circumferentially of the housing and rotor. Various problems have been encountered arising from the axial movement of the entire shaft and pointer. For instance, when the shaft moves axially, a portion thereof is exposed externally of the housing and can collect dust, dirt, etc., causing the shaft to stick in the displaced position. This, of course, detrimentally affects the functioning of the clock.

SUMMARY OF THE INVENTION

One object of the present invention is to provide an air operated clock having axially movable and rotatable elements wherein the axially movable elements are contained wholly within a housing to reduce the penetrability of dirt and grease collecting thereon.

A further object of the present invention is to provide an air operated clock which can easily and quickly be set to any desired initial time.

An additional object of the present invention is to provide an air operated clock which is relatively inexpensive to manufacture, yet rugged, and reliable in use.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
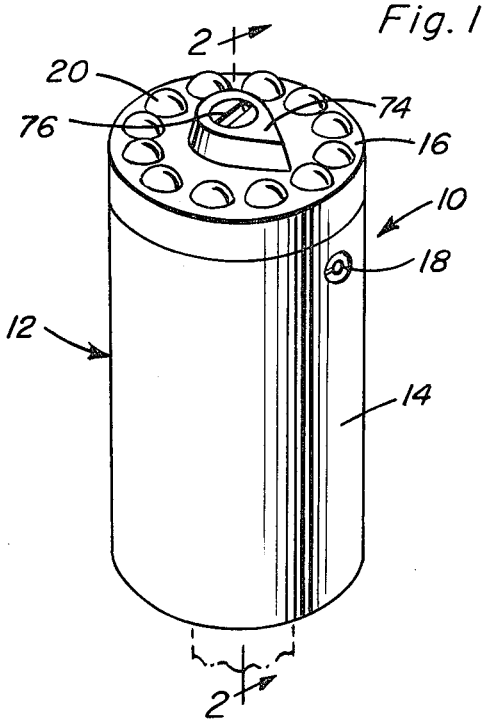
FIG. 1 is a perspective view of the air operated clock.
Figure 3:
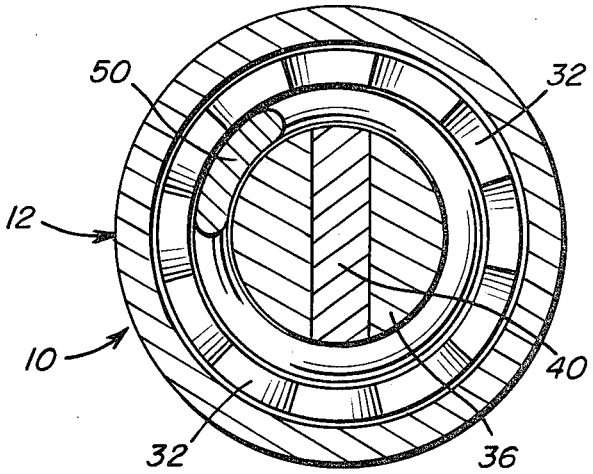
FIG. 3 is a top plan sectional view taken substantially along a plane passing through section line 3—3 of FIG. 2.
Figure 2:
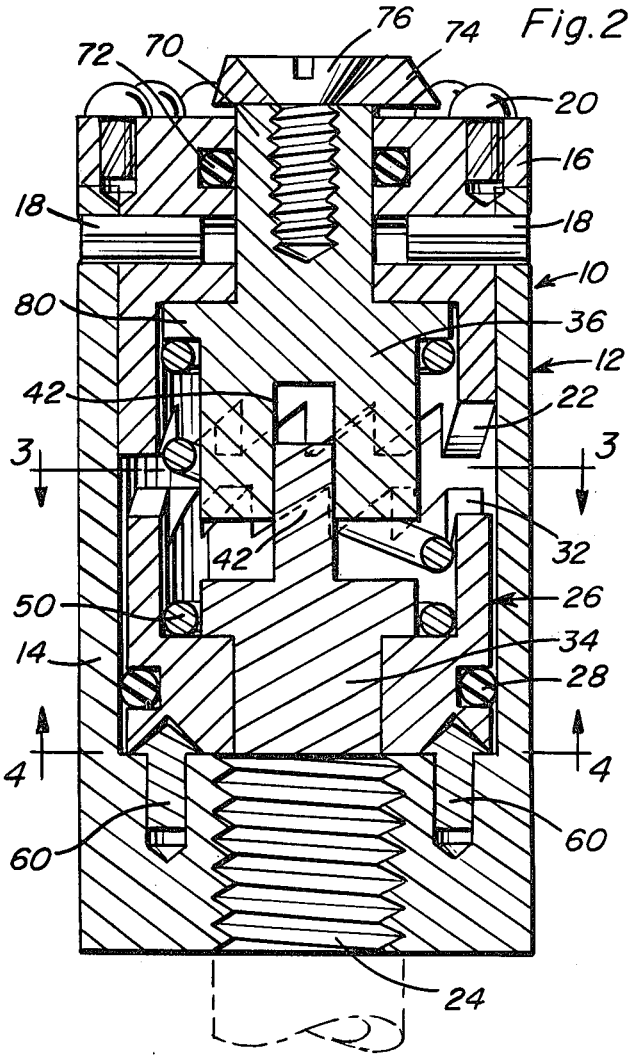
FIG. 2 is an elevational sectional view taken substantially along a plane passing through section line 2—2 of FIG. 1.
Figure 4:
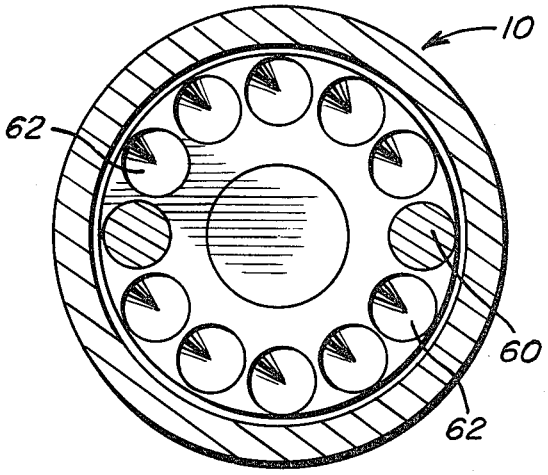
FIG. 4 is a bottom plan sectional view taken substantially along a plane passing through section line 4—4 of FIG. 2.
Figure 5:
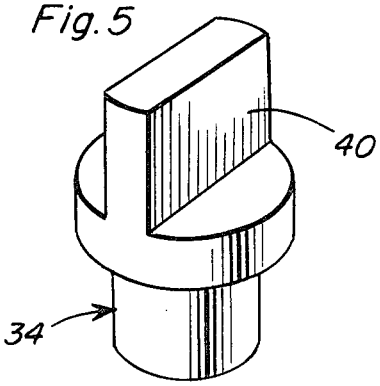
FIG. 5 is a perspective view of the key connector of the axially movable rotor section.

Now, with reference to the drawings, an air operated clock incorporating the principles and concepts of the present invention and generally referred to by the reference numeral 10 will be described in detail. The clock 10 includes a housing 12 which is generally cylindrical in shape and comprises a lower housing section 14 attached to housing cap 16 by a pair of pins 18 which pass through aligned apertures formed in the two housing sections. Circumferentially spaced along the top surface of cap 16 are twelve raised indicators 20 which can be the heads of drive screws mounted in appropriate openings formed in the cap 16. Of course, any other suitable indicators attached to or formed on the cap 16 would serve as well. The lower portion of cap 16 is cylindrical in shape and fits coaxially within the cylindrical bore of base 12. The lower free edge of the cap contains twelve 30-degree angled sawteeth 22. The base 14 contains a threaded opening 24 in the bottom thereof for receiving an air connector to communicate air pressure to the interior of the housing. A piston 26 is mounted in the lower portion of the housing and sealed against the bore thereof by O-ring 28 which seats in a peripheral groove formed on the external surface of the piston. The piston contains an upper free edge having 30-degree sawteeth 32 formed therein for coaction with sawteeth 22 of the cap 16. An axially movable section 34 of the clock rotor, comprising section 34 and section 36, is fixedly mounted in the center of the piston 26 for movement therewith. Clearly, when air pressure is applied through opening 24, the piston 26 nd section 34 move axially of the housing toward the cap teeth 22. When teeth 32 engage teeth 22, the piston 26 and section 34 of the rotor move in a clockwise direction within the housing. The clockwise movement is transmitted through the rotor section 34 to a spline-type connection comprising key 40 formed on rotor section 34 and keyway 42 formed within the lower portion of rotor section 36. As piston 26 moves upwardly within the bore of housing 12, key 40 moves upwardly within keyway 42. Once the teeth 22 and 32 mesh, the piston 26 rotates carrying rotor section 34 with it. Rotor section 34 rotates the upper rotor section 36 therewith. It is also noted that although key 40 is formed as a rectangular section and the keyway is shown as a straight through slot, any other formation inhibiting relative rotational translation but allowing longitudinal displacement of the two rotor sections would serve as well. Once the pressure through opening 24 is reduced, the piston 26 returns under the force of spring 50 to a position axially the same but rotatably displaced from its initial position. The rotational displacement causes the heads of drive screws 60 which are mounted in the housing base to be slightly misaligned with the next adjacent pairs of indentations 62 formed in the bottom of piston 26 from the previous indentations. Each head 60 has a conical surface with an 82-degree angle while the indentations 62 are conical with a 90-degree apical angle. Thus, the heads are seated within the indentations causing a final rotation of the piston 26 and the rotor.

The upper rotor section 36 includes a shaft 70 which extends through a shaft opening formed in the cap 16. An O-ring 72 is mounted in an annular groove formed in the cap to seal shaft 70. At the end of shaft 70, a pointer 74 is attached by flat head screw 76 which extends through an opening in the pointer and is received in a threaded hole formed in the shaft.

Pointer 74 can be aligned with any one of the indicators 20 by merely loosening screw 76 and rotating the pointer to the desired indicator. This can also be done with a screwdriver by turning all rotating parts of the clock in a clockwise direction. Upon actuation of the device, the pointer is rotated to the next indicator 20 upon completion of one cycle comprising engagement of the teeth 22, 32 and the seating of heads 60 in the next circumferentially adjacent openings 62. During the entire procedure, the upper rotor section 36 is held in place by the engagement of spring 50 with shoulder 80 of the rotor section. The spring also serves to bias the lower rotor section and the piston 26 away from the upper rotor section when low air pressure is communicated through opening 24. The upper rotor section 36 then rides directly against a lower abutting surface of the cap 16. This provides for a simple, efficient and effective design utilizing a minimum of components yet producing a smooth consistent clock operation. The indicators 20 are preferably hour indicators such that each movement of arm 74 registers an additional hour on the clock. Of course, finer or greater increments can be registered, as desired.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In an air pressure operated clock having a housing including a cylindrical bore formed therein, a first end having a plurality of time indicator markings, a shaft rotatably mounted through an opening in said first end and an indictor arm attached to said shaft for rotation therewith, said housing having a second end including an air inlet opening communicating with said cylindrical bore, a piston rotatably and axially displaceably mounted within said cylindrical bore, the improvement comprising: a two-piece rotor mounted within said cylindrical bore, one piece of said two-piece rotor being fixedly attached to said piston, the other piece of said two-piece rotor being fixedly attached to said shaft, a key extending from one piece of said two-piece rotor, a keyway formed in the other piece of said two-piece rotor receiving said key, and motion translation means for converting axial movement of said piston to rotational movement of said piston and rotor.

2. The invention as defined in claim 1 wherein said motion translation means includes a first set of teeth formed within said bore and fixed with respect to said housing, a second set of teeth formed on said rotor and disposed for engagement with said first set of teeth.

3. The invention as defined in claim 2 wherein said motion translation means further includes a plurality of conical apertures formed in circumferentially spaced relation about the bottom of said piston, at least one conical protrusion extending from said housing and positioned in operative relation for receiving one of said conical indentations.

4. The invention as defined in claim 3 wherein said conical protrusions each contain an apical angle which is greater than the apical angle of said conical indentations.

5. The invention as defined in claim 1 and further including a compression spring operatively engaging the two pieces of said two-piece rotor for biasing said two pieces apart.

6. The invention as defined in claim 1 and further including a screw passing through said indicator arm and being received in a threaded aperture in said shaft for holding said indicator arm to said shaft.

7. The invention as defined in claim 1 wherein said housing is formed with a base portion and a cap portion, said first teeth being formed on said cap portion.

8. The invention as defined in claim 1 wherein each of said teeth is formed with at least one 30-degree bevelled surface.

* * * * *